US007455597B2

(12) United States Patent
Matsunaga

(10) Patent No.: US 7,455,597 B2
(45) Date of Patent: Nov. 25, 2008

(54) GOLF CLUB HEAD

(75) Inventor: Hideo Matsunaga, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 214 days.

(21) Appl. No.: 11/451,402

(22) Filed: Jun. 13, 2006

(65) Prior Publication Data

US 2007/0129167 A1 Jun. 7, 2007

(30) Foreign Application Priority Data

Dec. 2, 2005 (JP) ..... 2005-349784

(51) Int. Cl.
*A63B 53/04* (2006.01)

(52) U.S. Cl. ..... 473/329; 473/345; 473/349

(58) Field of Classification Search ..... 473/324–350
See application file for complete search history.

(56) References Cited

U.S. PATENT DOCUMENTS 4,021,047 A * 5/1977 Mader ..... 473/345
4,139,196 A 2/1979 Riley
4,432,549 A * 2/1984 Zebelean ..... 473/346
4,438,931 A 3/1984 Motomiya
4,762,322 A 8/1988 Molitor et al.
4,874,171 A 10/1989 Ezaki et al.
5,004,241 A * 4/1991 Antonious ..... 473/327
5,205,560 A 4/1993 Hoshi et al.
5,346,217 A 9/1994 Tsuchiya et al.
5,346,218 A * 9/1994 Wyte ..... 473/346
RE34,925 E 5/1995 McKeighen
5,511,786 A 4/1996 Antonious
5,533,729 A 7/1996 Leu
5,706,566 A 1/1998 Igarashi
5,755,624 A * 5/1998 Helmstetter ..... 473/291
5,755,627 A * 5/1998 Yamazaki et al. ..... 473/345
5,954,596 A * 9/1999 Noble et al. ..... 473/346
5,967,904 A 10/1999 Nagai et al.
6,071,200 A 6/2000 Song
6,162,130 A 12/2000 Matsumoto et al.
6,248,025 B1 6/2001 Murphy et al.
6,280,349 B1 8/2001 Cook
6,322,459 B1 * 11/2001 Nishimura et al. ..... 473/330
6,334,817 B1 1/2002 Ezawa et al.
6,348,013 B1 2/2002 Kosmataka
6,494,790 B1 * 12/2002 Toyota et al. ..... 473/345
6,572,491 B2 6/2003 Hasebe et al.
6,595,871 B2 7/2003 Sano
6,645,086 B1 11/2003 Chen (Continued)

FOREIGN PATENT DOCUMENTS

JP 7-112041 A 5/1995

(Continued)

*Primary Examiner*—Sebastiano Passaniti
(74) *Attorney, Agent, or Firm*—Sughrue Mion, PLLC

(57) ABSTRACT

This invention provides a hollow golf club head having a face portion, a crown portion, a sole portion, and a side portion. The head has 0.3 to 0.6-mm thick thin-walled regions on the face side of the crown portion and the face side of the side portion, a medium-thick-walled region thicker than the thin-walled region of the crown portion at the back of the thin-walled region, and a high-rigidity region on the face side of the sole portion.

12 Claims, 4 Drawing Sheets

U.S. PATENT DOCUMENTS

| | | | | |
|---|---|---|---|---|
| 6,719,645 | B2 * | 4/2004 | Kouno | 473/345 |
| 6,783,465 | B2 | 8/2004 | Matsunaga | |
| 6,783,466 | B2 | 8/2004 | Seki et al. | |
| 6,880,222 | B2 | 4/2005 | Matsunaga | |
| 6,949,031 | B2 | 9/2005 | Imamoto et al. | |
| 7,137,906 | B2 * | 11/2006 | Tsunoda et al. | 473/324 |
| 7,241,230 | B2 * | 7/2007 | Tsunoda | 473/324 |
| 7,303,488 | B2 * | 12/2007 | Kakiuchi et al. | 473/346 |
| 2002/0123394 | A1 * | 9/2002 | Tsurumaki | 473/345 |
| 2003/0092506 | A1 | 5/2003 | Matsunaga | |
| 2004/0204264 | A1 | 10/2004 | Matsunaga et al. | |
| 2005/0026719 | A1 | 2/2005 | Yang | |
| 2005/0049081 | A1 * | 3/2005 | Boone | 473/346 |
| 2005/0119068 | A1 | 6/2005 | Onoda et al. | |
| 2005/0159243 | A1 | 7/2005 | Chuang | |
| 2006/0063609 | A1 * | 3/2006 | Lu | 473/346 |

FOREIGN PATENT DOCUMENTS

| | | | |
|---|---|---|---|
| JP | 7-112042 | A | 5/1995 |
| JP | 7-155410 | A | 6/1995 |
| JP | 8-126723 | A | 5/1996 |
| JP | 2001-353240 | A | 12/2001 |
| JP | 2003-79768 | A | 3/2003 |
| JP | 2005-211438 | A | 9/2006 |

* cited by examiner

GOLF CLUB HEAD

FIELD OF THE INVENTION

The present invention relates to a hollow golf club head which provides a large launch angle of a ball and a good rebound property when hitting a ball, to increase the traveling distance, and also provides favorable hitting impression and hitting sound.

BACKGROUND OF THE INVENTION

In recent years, a hollow golf club head has been proposed in which not only its face portion but also its crown portion elastically deforms, when hitting a ball, to increase the launch angle, so as to increase the traveling distance. For example, Japanese Patent Laid-Open Nos. 2003-79768 and 2005-211438 disclose such a golf club head in which the rigidity of a crown portion is decreased.

A golf club head described in Japanese Patent Laid-Open No. 2003-79768 comprises a metal-made hollow golf club head having at least a face portion, sole portion, side portion, and crown portion. A metal material that forms the crown portion has the lowest modulus of longitudinal elasticity.

A golf club head described in Japanese Patent Laid-Open No. 2005-211438 comprises a metal-made hollow golf club head having at least a face portion, sole portion, side portion, and crown portion. Metal materials that form the crown portion and at least the upper portion of the side portion have the lowest modulus of longitudinal elasticity.

The golf club heads described in Japanese Patent Laid-Open Nos. 2003-79768 and 2005-211438 still have room for improvement in terms of increasing the launch angle and improving the rebound property when hitting a ball. In addition, in the golf club heads described in Japanese Patent Laid-Open Nos. 2003-79768 and 2005-211438, when the rigidity of a crown portion is decreased, the hitting impression sometimes get worse and the hitting sound sometimes becomes lower.

SUMMARY OF THE INVENTION

The present invention has been made in order to overcome the deficits of prior art.

According to the aspects of the present invention, there is provided golf club heads described in (1) to (5) below.

(1) A hollow golf club head having a face portion, a crown portion, a sole portion, and a side portion, wherein the head comprises 0.3 to 0.6-mm thick thin-walled regions on a face side of the crown portion and a face side of the side portion, a medium-thick-walled region thicker than the thin-walled region of the crown portion at the back of the thin-walled region, and a high-rigidity region on a face side of the sole portion.

(2) The head according to (1), comprising a thick-walled region 5 to 10 mm wide in a longitudinal direction of the head, on a crown side and side side of the face portion.

(3) A hollow golf club head having face portion, a crown portion, a sole portion, and a side portion, wherein the head comprises 0.3 to 0.6-mm thick thin-walled regions on a face side of the crown portion and a face side of the side portion, a medium-thick-walled region thicker than the thin-walled region of the crown portion at the back of the thin-walled region, and a thick-walled region thicker than the medium-thick-walled region of the crown portion at the back of the medium-thick-walled region.

(4) The head according to (3), comprising a thick-walled region 5 to 10 mm wide in a longitudinal direction of the head, on a crown side and side side of the face portion.

(5) The head according to (3), comprising a high-rigidity region on a face side of the sole portion.

According to the aspects of the present invention, the sole portion of the golf club head refers to a portion extending backward from the lower portion of the face portion to form the bottom portion of the head. The crown portion of the golf club head refers to a portion extending backward from the upper portion of the face portion to form the upper portion of the head. The side portion of the golf club head refers to a portion extending backward from between the upper and lower portions of the face portion to form a head side portion. The side portion includes a toe-side side portion, heel-side side portion, and back-side side portion.

According to the aspects of the present invention, when the 0.3 to 0.6-mm thick thin-walled regions are formed on the face side of the crown portion and the face side of the side portion, the widths of the thin-walled regions in the longitudinal direction of the head are preferably 20 to 50 mm, and more preferably 20 to 40 mm. The thin-walled regions of the crown portion and side portion are preferably formed continuously to each other. The more preferable thicknesses of the thin-walled regions are 0.4 to 0.6 mm.

According to the aspects of the present invention, when the medium-thick-walled region is formed at the back of the thin-walled region of the crown portion, the thickness of the medium-thick-walled region is preferably 0.3 to 1.2 mm, and more preferably 0.6 to 0.8 mm. The width of the medium-thick-walled region in the longitudinal direction of the head is preferably 10 to 60 mm, and more preferably 30 to 50 mm.

According to the aspects of the present invention, when the thick-walled region is formed at the back of the medium-thick-walled region of the crown portion, the thickness of the thick-walled region is preferably 0.3 to 1.8 mm larger than that of the medium-thick-walled region, and more preferably 0.5 to 1.5 mm larger than that of the medium-thick-walled region. The width of the thick-walled region in the longitudinal direction of the head is preferably 5 to 30 mm, and more preferably 10 to 25 mm. When the above thick-walled region is formed in the crown portion, the rigidity of the crown portion is different according to each region of the crown portion. Therefore, the natural frequency of the golf club head is different from that of a conventional golf club head of which crown portion has uniform thickness, and hitting impression and hitting sound can be improved.

According to the aspects of the present invention, as means for forming the high-rigidity region on the face side of the sole portion, means for forming the thick-walled region on the face side of the sole portion or means for forming a rib on the face side of the sole portion can be employed. When the thick-walled region is formed on the face side of the sole portion, the thickness of the thick-walled region is preferably 1.5 to 3 mm, and more preferably 1.5 to 2.5 mm. When the rib is formed on the face side of the sole portion, the height of the rib is appropriately 0.5 to 3.0 mm, and more appropriately 1.0 to 2.0 mm. The width of the thick-walled region or a rib formation region in the longitudinal direction of the head is preferably 20 to 50 mm, and more preferably 20 to 40 mm. Furthermore, the thickness of a region other than the thick-walled region or rib formation region of the sole portion is suitably 0.7 to 2.0 mm, and more suitably 0.9 to 1.5 mm. When the high-rigidity region is formed in the sole portion, the wall thickness of a portion of the sole portion other than the portion which affects the impact can be decreased.

Accordingly, the size of the head can be readily increased. In addition, a more preferable golf club head can be designed by using another barycentral design such as a back weight or thick-walled portion formed inside a heel-side side portion (to be described later).

According to the aspects of the present invention, when the thick-walled region having the width of 5 to 10 mm in the longitudinal direction of the head is formed on the crown side and side side of the face portion, the thick-walled region can be formed, for example, along a welding portion of a head main body to a face member. The thick-walled region is preferably formed so that a surface (a surface which exposes to a hollow portion of the golf club head) of the thick-walled region becomes an inclined surface. The width (thickness) of a region in the longitudinal direction of the head other than the thick-walled region of the face portion is suitably 2 to 5 mm. When the thick-walled region is formed in the face portion, the strength of the golf club head is ensured. Therefore, denting the golf club head when hitting a ball at the corner portion of the face portion by mistake can be prevented.

According to the aspects of the present invention, the barycentric depth can be increased by arranging the back weight at the inside near the rear end portion of the sole portion or at the inside of the back-side side portion. In this case, for example, a screw having the mass of 3 to 30 g and made of a tungsten-nickel alloy can be used as the back weight.

According to the aspects of the present invention, when the thick-walled portion is formed at the inside of the heel-side side portion, the length to the center of gravity can be appropriately adjusted to obtain a golf club head which is easy to swing. In this case, the thickness of the thick-walled portion is suitably 1.2 to 3.0 mm.

How to manufacture the golf club head according to the aspects of the present invention is not particularly limited. For example, the golf club head can be manufactured by closing a face opening of the head main body with a face member. In this case, the material and forming method of the head main body are not particularly limited. As the material, titanium, a titanium alloy, stainless steel, an amorphous material, or the like can be used. As the forming method, casting can be used. The golf club head according to the aspects of the present invention has regions having different thicknesses. Therefore, the head main body is preferably manufactured by casting, more preferably investment casting.

When the head main body has a sole opening, at least the crown portion and side portion are preferably manufactured by casting. The sole portion can be made up of regions having different thicknesses.

The material and forming method of the face member are not particularly limited, either. As the material, titanium, a titanium alloy, stainless steel, an amorphous material, or the like can be used. As the molding method, forging, press forming of pressing a plate material, or die casting is preferable.

How to joint the face member to the head main body having the face opening is not particularly limited, but plasma welding, laser welding, or electron beam welding is suitable in terms of finishing the bonding portion with a good appearance and improving the weight accuracy of the golf club head. Particularly, plasma welding is suitable. In this case, as plasma welding, known plasma welding can be employed in which a welding target material is dissolved by a high-temperature energy generated by plasma arc and solidified again to weld. As laser welding, known laser welding which uses a gas laser such as CO laser or $CO_2$ laser, or a solid laser such as YAG laser can be employed. As electron beam welding, known electron beam welding which uses an electron beam having an appropriate output can be employed.

Other features and advantages of the present invention will be apparent from the following descriptions taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENT

A preferred embodiment of the present invention will now be described in detail in accordance with the accompanying drawings.

Figure 1:
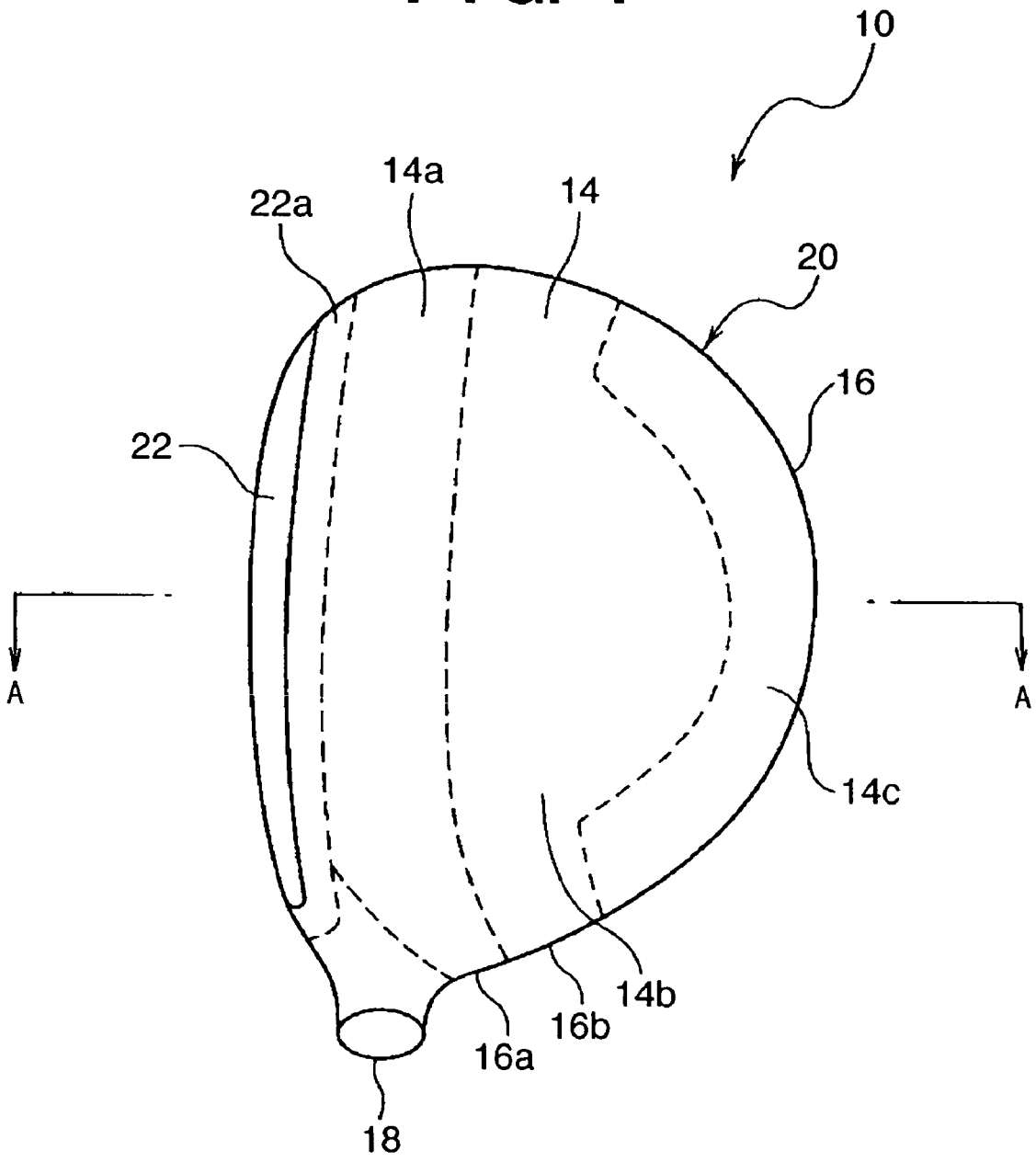
FIG. 1 is a plan view showing an embodiment of a golf club head according to the present invention.
Figure 2:
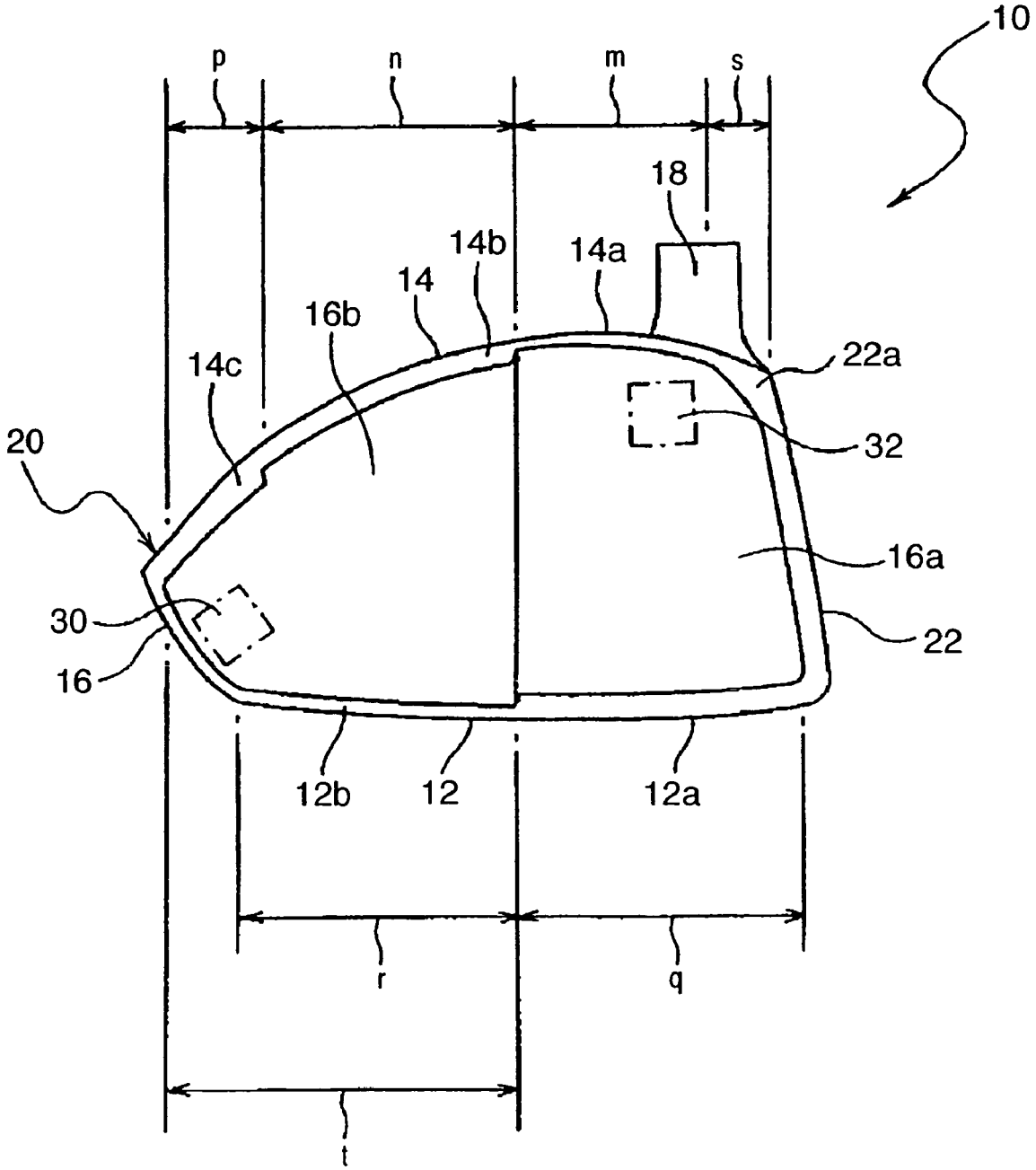
FIG. 2 is a sectional view taken along the line A-A of FIG. 1.

An embodiment of the present invention will be described with reference to accompanying drawings, although the present invention is not limited to the embodiment described below. FIG. 1 is a plan view showing an embodiment of a golf club head according to the present invention, and FIG. 2 is a sectional view taken along the line A-A of FIG. 1.

A golf club head 10 according to this embodiment is obtained by fixing a face member 22 to the face opening of a head main body 20 having a sole portion 12, crown portion 14, side portion 16, and hosel portion 18. Both the head main body 20 and the face member 22 are made of a titanium alloy. The golf club head 10 of this embodiment is formed as a No. 1 wood golf club head.

In the golf club head 10 according to this embodiment, thin-walled regions 14*a* and 16*a* having the thicknesses of 0.3 to 0.6 mm are formed on the face side of the crown portion 14 and that of the side portion 16, respectively. In this case, the thin-walled region 14*a* of the crown portion 14 and the thin-walled region 16*a* of the side portion 16 are formed continuously to each other. Widths m of the thin-regions 14*a* and 16*a* in the longitudinal direction of the head are 20 to 50 mm.

In the golf club head 10 according to this embodiment, a medium-thick-walled region 14*b*, which is thicker than the thin-walled region 14*a*, is formed at the back of the thin-walled region 14*a* of the crown portion 14. The thickness of the medium-thick-walled region 14*b* is 0.3 to 1.2 mm. A width n of the medium-thick-walled region 14*b* in the longitudinal direction of the head is 20 to 40 mm.

In the golf club head 10 according to this embodiment, a thick-walled region 14*c*, which is thicker than the medium-thick-walled region 14*b*, is formed at the back of the medium-thick-walled region 14*b* of the crown portion 14. The thickness of the thick-walled region 14*c* is 0.3 to 1.8 mm larger than that of the medium-thick-walled region 14*b*. A width p of the thick-walled region 14*c* in the longitudinal direction of the head is 10 to 25 mm.

In the golf club head 10 according to this embodiment, a thick-walled region 16*b*, which is thicker than the thin-walled region 16*a*, is formed at the back of the thin-walled region 16*a* of the side portion 16. The thickness of the thick-walled region 16*b* is 0.6 to 1.5 mm. A width t of the thick-walled region 16*b* in the longitudinal direction of the head is 40 to 80 mm.

In the golf club head 10 according to this embodiment, a thick-walled region 12*a* is formed as a high-rigidity region on the face side of the sole portion 12. The thickness of the thick-walled region 12*a* is 1.5 to 3 mm. A width q of the thick-walled region 12*a* in the longitudinal direction of the head is 20 to 50 mm.

In the golf club head 10 according to this embodiment, a thin-walled region 12*b*, which is thinner than the thick-walled region 12*a*, is formed at the back of the thick-walled region 12*a* of the sole portion 12. The thickness of the thin-walled region 12*b* is 0.7 to 1.5 mm. A width r of the thin-walled region 12*b* in the longitudinal direction of the head is 30 to 60 mm.

In the golf club head 10 according to this embodiment, a thick-walled region 22*a* having a width s of 5 to 10 mm in the longitudinal direction of the head is formed on the crown side and side side of the face portion 22. The thick-walled region 22*a* is formed along a welding portion of the head main body 20 to a face member 22.

In the golf club head 10 according to this embodiment, a back weight 30 can be arranged at the inside near the rear end portion of the sole portion or at the inside of the back-side side portion. Alternatively, a thick-walled portion 32 can be arranged at the inside of the heel-side side portion.

EXAMPLES & COMPARATIVE EXAMPLES

Golf club heads of models 1 to 8 were manufactured, in which the thicknesses of the portions corresponding to the crown thin-walled region 14*a*, crown medium-thick-walled region 14*b*, crown thick-walled region 14*c*, side thin-walled region 16*a*, side thick-walled region 16*b*, sole thick-walled region 12*a*, and sole thin-walled region 12*b* in the golf club head shown in FIGS. 1 and 2 were set as in Table 1. In this case, the widths in the longitudinal direction of the head, of the crown thin-walled region 14*a*, crown medium-thick-walled region 14*b*, crown thick-walled region 14*c*, side thin-walled region 16*a*, side thick-walled region 16*b*, sole thick-walled region 12*a*, and sole thin-walled region 12*b* were set 30 mm, 45 mm, 20 mm, 30 mm, 60 mm, 30 mm, 55 mm, respectively. Of the above models 1 to 8, models 5 to 8 are examples of the present invention, and models 1 to 4 are comparative examples.

TABLE 1

| | Thickness (mm) | | | | | | |
|---|---|---|---|---|---|---|---|
| | Crown Thin-walled Region 14a | Crown Medium-thick-walled Region 14b | Crown Thick-walled Region 14c | Side Thin-walled Region 16a | Side Thick-walled Region 16b | Sole Thick-walled Region 12a | Sole Thin-walled Region 12b |
| Model 1 | 1.0 | 1.0 | 1.0 | 1.0 | 1.0 | 1.2 | 1.2 |
| Model 2 | 0.5 | 0.5 | 0.5 | 1.0 | 1.0 | 1.2 | 1.2 |
| Model 3 | 0.5 | 1.0 | 1.0 | 1.0 | 1.0 | 1.2 | 1.2 |
| Model 4 | 0.5 | 0.8 | 1.5 | 1.0 | 1.0 | 1.2 | 1.2 |
| Model 5 | 0.5 | 0.8 | 1.5 | 0.5 | 1.0 | 1.2 | 1.2 |
| Model 6 | 0.5 | 0.8 | 1.5 | 0.5 | 1.0 | 2.0 | 1.2 |
| Model 7 | 0.3 | 1.0 | 2.8 | 0.3 | 1.0 | 1.5 | 1.0 |
| Model 8 | 0.6 | 1.2 | 1.5 | 0.6 | 1.2 | 2.0 | 1.2 |

Figure 3:
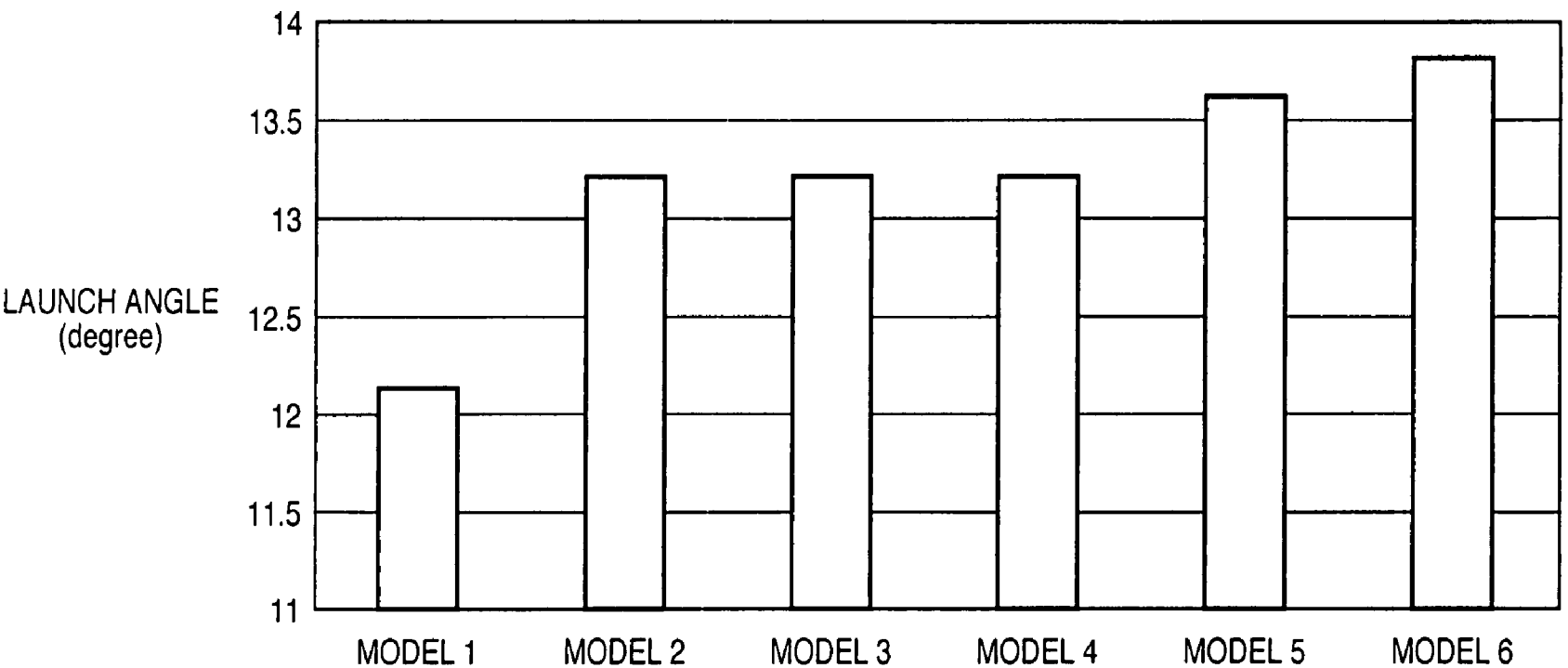
FIG. 3 is a graph showing a launching angle of a golf ball in an impact test for an example of the present invention.
Figure 4:
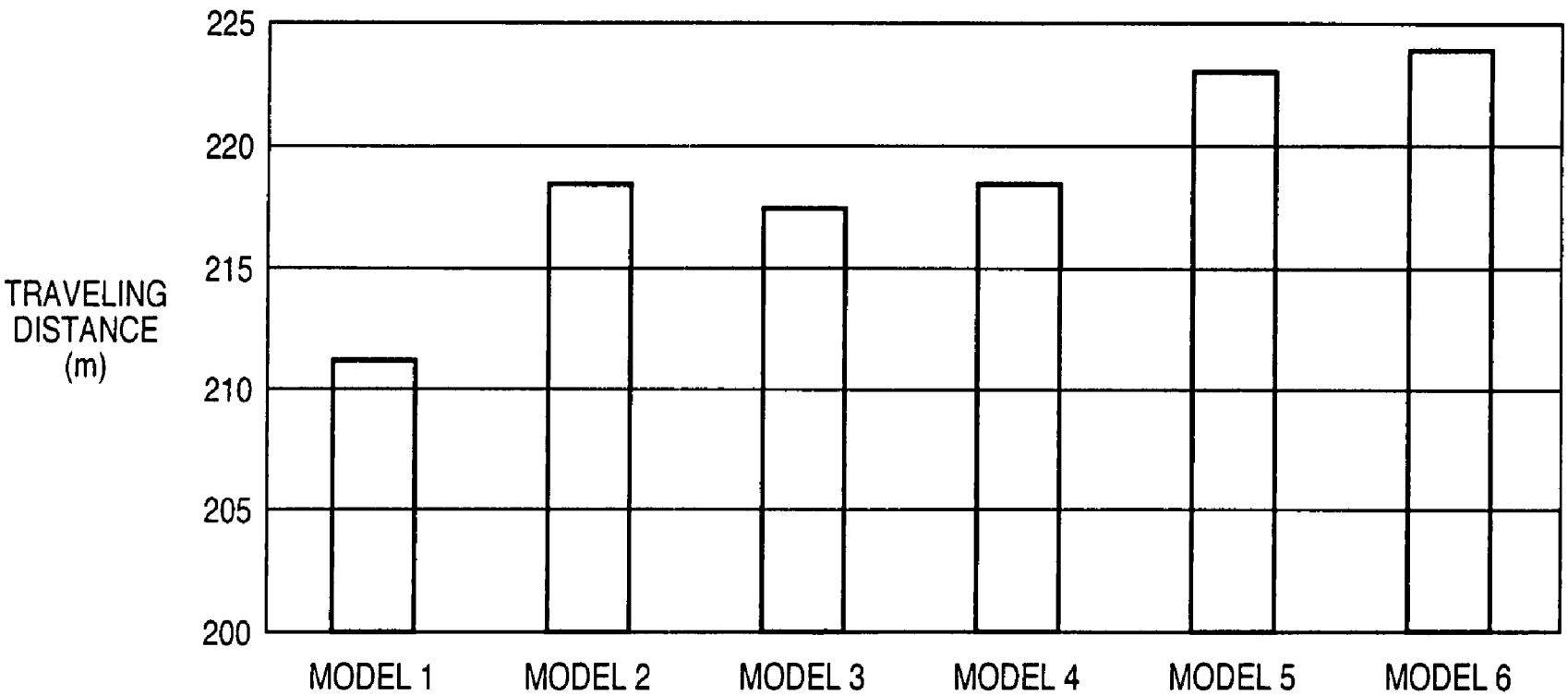
FIG. 4 is a graph showing a traveling distance of a golf ball in the impact test for the example of the present invention.

Golf clubs were manufactured by using the above golf club heads. An impact test machine was used to hit a golf ball with each golf club at the head speed of 45 m/s, to check ball initial speed, launch angle, back spin amount, and traveling distance, for each golf club. The results are shown in Table 2. The results of the launch angle and traveling distance are shown in FIGS. 3 and 4, respectively. In addition, an impact organoleptic evaluation test was performed by five advanced players using the above golf clubs, to evaluate the hitting impression and hitting sound. The results are shown in Table 3.

TABLE 2

| | Ball Initial Speed (m/s) | Launch Angle (°) | Back Spin Amount (rpm) | Traveling Distance (m) |
|---|---|---|---|---|
| Model 1 | 62.5 | 12.1 | 2830 | 211.5 |
| Model 2 | 63.3 | 13.2 | 2750 | 218.7 |
| Model 3 | 63.2 | 13.2 | 2790 | 217.8 |
| Model 4 | 63.3 | 13.2 | 2720 | 218.8 |
| Model 5 | 63.5 | 13.6 | 2580 | 223.2 |
| Model 6 | 63.3 | 13.8 | 2540 | 224.2 |

TABLE 3

| | Hitting Impression | Hitting Sound | Comment |
|---|---|---|---|
| Model 1 | ○ | ◎ | hard, just-hit impression, high-pitched sound |
| Model 2 | Δ | Δ | rebound but no just-hit impression, irresponsive, unsatisfied, low-pitched sound (dull) |
| Model 3 | ○ | ○ | got high-pitched, good balance |
| Model 4 | ○ | ○ | favorable hitting impression, got high-pitched, just-hit impression |
| Model 5 | ○ | ○ | rebounding impression, got high-pitched, slightly irresponsive |
| Model 6 | ◎ | ◎ | just-hit impression, high-pitched sound, rebounding impression |
| Model 7 | ○ | ◎ | favorable hitting impression, got high-pitched |
| Model 8 | ◎ | ◎ | favorable hitting impression, high-pitched sound and rebounding impression |

The results shown in Tables 2 and 3 and FIGS. 3 and 4 ensure that the examples of the present invention provides a large launch angle and a good rebound property when hitting a ball, thereby increasing the traveling distance, and also provides favorable hitting impression and hitting sound.

As many apparently widely different embodiments of the present invention can be made without departing from the spirit and scope thereof, it is to be understood that the invention is not limited to the specific embodiments thereof except as defined in the appended claims.

This application claims the benefit of Japanese Patent Application No. 2005-349784 filed on Dec. 2, 2005, which is hereby incorporated by reference herein in its entirety.

What is claimed is:

1. A hollow golf club head having a face portion, a crown portion, a sole portion, and a side portion, wherein said head comprises:

a thin-walled region of said crown portion located adjacent to said face portion and having a thickness between 0.3 and 0.6 mm;

a thin-walled region of said side portion located nearest to said face portion and having a thickness between 0.3 and 0.6 mm;

a medium-thick-walled region, which is thicker than said thin-walled region of said crown portion, and is located behind said thin-walled region in a direction away from said face portion; and a high-rigidity region of said sole portion located adjacent to said face portion.

2. The head according to claim 1, comprising a thick-walled region of said face portion located adjacent to said crown portion and nearest said side portion and having a width of between 5 and 10 mm in a longitudinal direction of the head.

3. A hollow golf club head having a face portion, a crown portion, a sole portion, and a side portion, wherein said head comprises:

a thin-walled region of said crown portion located adjacent to said face portion and having a thickness between 0.3 and 0.6 mm;

a thin-walled region of said side portion located nearest to said face portion and having a thickness between 0.3 and 0.6 mm;

a medium-thick-walled region, which is thicker than said thin-walled region of said crown portion, and is located behind said thin-walled region in a direction away from said face portion; and a thick-walled region, which is thicker than said medium-thick-walled region of said crown portion, and is located behind said medium-thick-walled region in the direction away from said face portion.

4. The head according to claim 3, comprising a thick-walled region of said face portion located adjacent to said crown portion and nearest said side portion and having a width of between 5 and 10 mm in a longitudinal direction of the head.

5. The head according to claim 3, comprising a high-rigidity region of said sole portion located adjacent to said face portion.

6. A hollow golf club head having a face portion, a crown portion, a sole portion, and a side portion, wherein said head comprises:

a thin-walled region of said crown portion located adjacent to said face portion;

a thin-walled region of said side portion located nearest to said face portion;

a medium-thick-walled region, which is thicker than said thin-walled regions of said crown portion and said side portion, and is located behind said thin-walled regions in a direction away from said face portion, said medium-thick-walled region having a thickness between 0.3 and 1.2 mm; and a high-rigidity region of said sole portion located adjacent to said face portion.

7. The head according to claim 6, wherein said medium-thick-walled region has a thickness between 0.6 and 0.8 mm.

8. The head according to claim 6, comprising a thick-walled region of said face portion located adjacent to said crown portion and nearest said side portion and having a width of between 5 and 10 mm in a longitudinal direction of the head.

9. A hollow golf club head having a face portion, a crown portion, a sole portion, and a side portion, wherein said head comprises:

a thin-walled region of said crown portion located adjacent to said face portion;

a thin-walled region of said side portion located nearest to said face portion;

a medium-thick-walled region, which is thicker than said thin-walled regions of said crown portion and said side portion, and is located behind said thin-walled regions in a direction away from said face portion, said medium-thick-walled region having a thickness between 0.3 and 1.2 mm; and a thick-walled region, which is thicker than said medium-thick-walled region of said crown portion, and is located behind said medium-thick-walled region in the direction away from said face portion.

10. The head according to claim 9, wherein said medium-thick-walled region has a thickness between 0.6 and 0.8 mm.

11. The head according to claim 9, comprising a thick-walled region of said face portion located adjacent to said crown portion and nearest said side portion and having a width of between 5 and 10 mm in a longitudinal direction of the head.

12. The head according to claim 9, comprising a high-rigidity region of said sole portion located adjacent to said face portion.

* * * * *